US008855900B2

(12) United States Patent
Lection et al.

(10) Patent No.: US 8,855,900 B2
(45) Date of Patent: Oct. 7, 2014

(54) SYSTEM AND METHOD FOR SELF-OPTIMIZING TRAFFIC FLOW USING SHARED VEHICLE INFORMATION

(75) Inventors: David B. Lection, Raleigh, NC (US); Eric L. Masselle, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 505 days.

(21) Appl. No.: 13/177,366

(22) Filed: Jul. 6, 2011

(65) Prior Publication Data

US 2013/0013179 A1 Jan. 10, 2013

(51) Int. Cl.

| | |
|---|---|
| ***G08G 1/01*** | (2006.01) |
| ***G08G 1/07*** | (2006.01) |
| ***G08G 1/08*** | (2006.01) |
| ***G08G 1/081*** | (2006.01) |

(52) U.S. Cl.

CPC ..... *G08G 1/0137* (2013.01); *G08G 1/0112* (2013.01); *G08G 1/0145* (2013.01); *G08G 1/07* (2013.01); *G08G 1/08* (2013.01); *G08G 1/081* (2013.01)

USPC ..... 701/117; 701/119; 340/928; 340/907

(58) Field of Classification Search

USPC ..... 701/117

See application file for complete search history.

(56) References Cited

U.S. PATENT DOCUMENTS

| | | | | |
|---|---|---|---|---|
| 6,418,371 | B1 * | 7/2002 | Arnold | 701/117 |
| 7,236,881 | B2 | 6/2007 | Liu et al. | |
| 7,425,903 | B2 | 9/2008 | Boss et al. | |
| 7,443,284 | B2 | 10/2008 | Curtis | |
| 7,782,227 | B2 | 8/2010 | Boss et al. | |
| 7,859,431 | B2 * | 12/2010 | Peddie et al. | 340/907 |
| 2005/0104747 | A1 * | 5/2005 | Silic et al. | 340/944 |
| 2005/0270175 | A1 * | 12/2005 | Peddie et al. | 340/907 |
| 2007/0135990 | A1 | 6/2007 | Seymour et al. | |
| 2007/0273552 | A1 * | 11/2007 | Tischer | 340/910 |

(Continued)

FOREIGN PATENT DOCUMENTS

| | | | | |
|---|---|---|---|---|
| DE | 102004002808 | * | 9/2004 | G08G 1/01 |
| JP | 2009146138 | | 7/2009 | |

(Continued)

OTHER PUBLICATIONS

Intellectual Property Office, GB1208998.3 Combined Search and Examination Report, Sep. 18, 2012.

*Primary Examiner* — Shelley Chen

(74) *Attorney, Agent, or Firm* — Cahn & Samuels, LLP

(57) ABSTRACT

A system and method for self-optimizing traffic flow using shared vehicle information that utilizes multiple controllers in dynamic communication to optimize the flow of traffic. The system and method utilizes one or more traffic synchronization controllers (TSCs) (receivers) that receive information from one or more vehicle based transmitters called vehicle information agents (VIAs) and/or a network of traffic control devices (TCDs) associated with the traffic synchronization controllers to determine a variety of information related to traffic within a geographic region, including volume, speed, destination, intended route of the vehicle, as well as other vehicle related information, in order to determine the optimal flow of traffic within the region. The system and method then transmits traffic control signals to the various traffic control devices within the region or adjacent regions in order to optimally control the flow of traffic. The system and method may also share information amongst traffic synchronization controllers within the network in order to optimize the flow of traffic over a larger region.

19 Claims, 5 Drawing Sheets

(56) References Cited

U.S. PATENT DOCUMENTS

| | | | | |
|---|---|---|---|---|
| 2008/0303694 | A1* | 12/2008 | Ury | 340/907 |
| 2009/0115632 | A1* | 5/2009 | Park | 340/905 |
| 2009/0256722 | A1 | 10/2009 | Mase | |
| 2009/0256723 | A1* | 10/2009 | Peddie et al. | 340/907 |
| 2010/0214126 | A1 | 8/2010 | Publicover | |
| 2011/0037619 | A1 | 2/2011 | Ginsberg et al. | |
| 2011/0121993 | A1* | 5/2011 | Davis et al. | 340/911 |
| 2012/0249341 | A1* | 10/2012 | Brown et al. | 340/902 |

FOREIGN PATENT DOCUMENTS

| | | | |
|---|---|---|---|
| JP | 2009146138 | A * | 7/2009 |
| JP | 2011203933 | | 5/2011 |
| JP | 2011203933 | A * | 10/2011 |

* cited by examiner

SYSTEM AND METHOD FOR SELF-OPTIMIZING TRAFFIC FLOW USING SHARED VEHICLE INFORMATION

I. FIELD OF THE INVENTION

The present invention relates generally to dynamic transportation network controls. More particularly, the present invention relates to a system and method for self-optimizing traffic flow using shared vehicle information that utilizes multiple controllers in dynamic communication to optimize the flow of traffic.

II. BACKGROUND OF THE INVENTION

Transportation systems are relied on to move people and goods (cargo) from one location to another location. Over the years, transportation systems have developed from simple isolated collections of streets to more robust systems. Modern transportation systems include many interconnected streets, roads, and highways that form integrated local, state and interstate highway systems.

These systems are often designed to seamlessly function together to promote the efficient flow of traffic. However, due to the ubiquity of vehicles and the ever-increasing demand imposed on the transportation system by countless individuals, businesses and other organizations, modern transportation systems have become increasingly congested with vehicle traffic. Poor traffic controls exacerbate the problem associated with congestion. Further, congestion is particularly problematic in metropolitan areas where there typically exist an enormous number of vehicles within the transportation system at any given time. These problems are further heightened during the morning and evening commutes, holidays, and during special events such as sporting events, concerts, and the like where the concentration of vehicles in a region quickly burgeons. This congestion results in enormous inefficiency including long delays, increased fuel costs, bottlenecks, elevated pollution levels (from engine exhaust), increased accident rates, high driver stress, and a generally negative impact on communities.

These inefficiencies have challenged engineers and planners to design transportation systems including associated traffic controls that permit an optimal flow of vehicles. A further challenge is presented because a system that is optimal for some time periods may be far from optimal during other time periods, e.g., during commute times, special events, or on particular days.

III. SUMMARY OF THE INVENTION

In at least one embodiment the present invention provides a system for optimizing traffic flow based on information transmitted from one or more vehicle information agents, including at least one traffic synchronization controller in communication with at least one vehicle information agent, wherein said at least one traffic synchronization controller receives information transmitted by said at least one vehicle information agent, and calculates an optimal traffic flow within a region based on the received information; and, at least one traffic control device in communication with said at least one traffic synchronization controller, wherein said at least one traffic control device receives the calculated optimal traffic flow from said at least one traffic synchronization controller, and dynamically maintains or changes states in order to facilitate the calculated optimal traffic flow within the region.

In at least one embodiment the present invention provides a method for optimizing traffic flow based on information transmitted by one or more vehicle information agents, including providing one or more traffic synchronization controllers within a region, wherein said one or more traffic synchronization controllers is capable of receiving and transmitting information related to one or more vehicles; providing one or more traffic control devices within the region, wherein said one or more traffic control devices is capable of dynamically changing control states; receiving on said one or more traffic synchronization controllers information transmitted by one or more vehicle information agents; calculating an optimal traffic flow within the region based on the information received; and, dynamically maintaining or changing the state of one or more traffic control devices within the region to facilitate the calculated optimal traffic flow within the region.

In at least one embodiment the present invention provides a system for optimizing traffic flow including at least one vehicle information agent capable of being disposed on a vehicle, wherein said at least one vehicle information agent is capable of transmitting information; at least one traffic synchronization controller in communication with said at least one vehicle information agent, wherein said at least one traffic synchronization controller includes means for transmitting various information related to the progress of at least one vehicle within a traffic region; means for receiving said transmitted information related to the progress of at least one vehicle within a traffic region, means for calculating an optimal traffic flow within the region based on the received information; and, means for dynamically maintaining or changing at least one traffic control signal in response to the calculated optimal traffic flow in order to facilitate said optimal calculated traffic flow within the region.

In at least one embodiment the present invention provides a system for optimizing traffic flow including at least one vehicle information agent capable of being disposed on an automobile, wherein said at least one vehicle information agent transmits information related to said automobile; at least one traffic synchronization controller in communication with said at least one vehicle information agent, wherein said at least one traffic synchronization controller receives information transmitted by said at least one vehicle information agent, and calculates an optimal traffic flow within a region based on the received information; and, at least one traffic control device in communication with said at least one traffic synchronization controller, wherein said at least one traffic control device receives the calculated optimal traffic flow from said at least one traffic synchronization controller, and dynamically maintains or changes states in order to facilitate the calculated optimal traffic flow within the region.

IV. BRIEF DESCRIPTION OF THE DRAWINGS

Given the following enabling description of the drawings, the method and apparatus should become evident to a person of ordinary skill in the art.

V. DETAILED DESCRIPTION OF THE DRAWINGS

The present invention discloses a system and method of controlling traffic utilizing a network of receivers associated with traffic control devices and vehicle-based transmitters. In at least one embodiment, the present invention utilizes at least one receiver or Traffic Synchronization Controller (TSC) in communication with one or more traffic control devices, such as dynamic street signs, traffic lights, and speed limit signs, and vehicle-based transmitters, called a Vehicle Information Agent (VIA), to collect information related to the traffic within a defined geographic area. The system and method, in at least one embodiment, utilizes the collected traffic information to dynamically control the state of the traffic control devices within a defined geographic region to ensure the optimal flow of traffic within the defined region. In at least another embodiment, the present invention includes a central facility in communication with one or more Traffic Synchronization Controllers (TSC) wherein the central facility collects information from the one or more TSCs, dynamically calculates the adjustments needed to ensure the optimal flow of traffic and promulgates the changes to each TSC. The TSCs then maintain or change the state of the associated traffic control devices based on these calculations to ensure the optimal flow of traffic within the defined region. In various embodiments, the TSCs are capable of operating autonomously or as a slave to a shared central processing facility. Further, the level of autonomy of the TSC may be adjusted according to the state or performance of the system, or according to the availability of the central processing facility.

Figure 1:
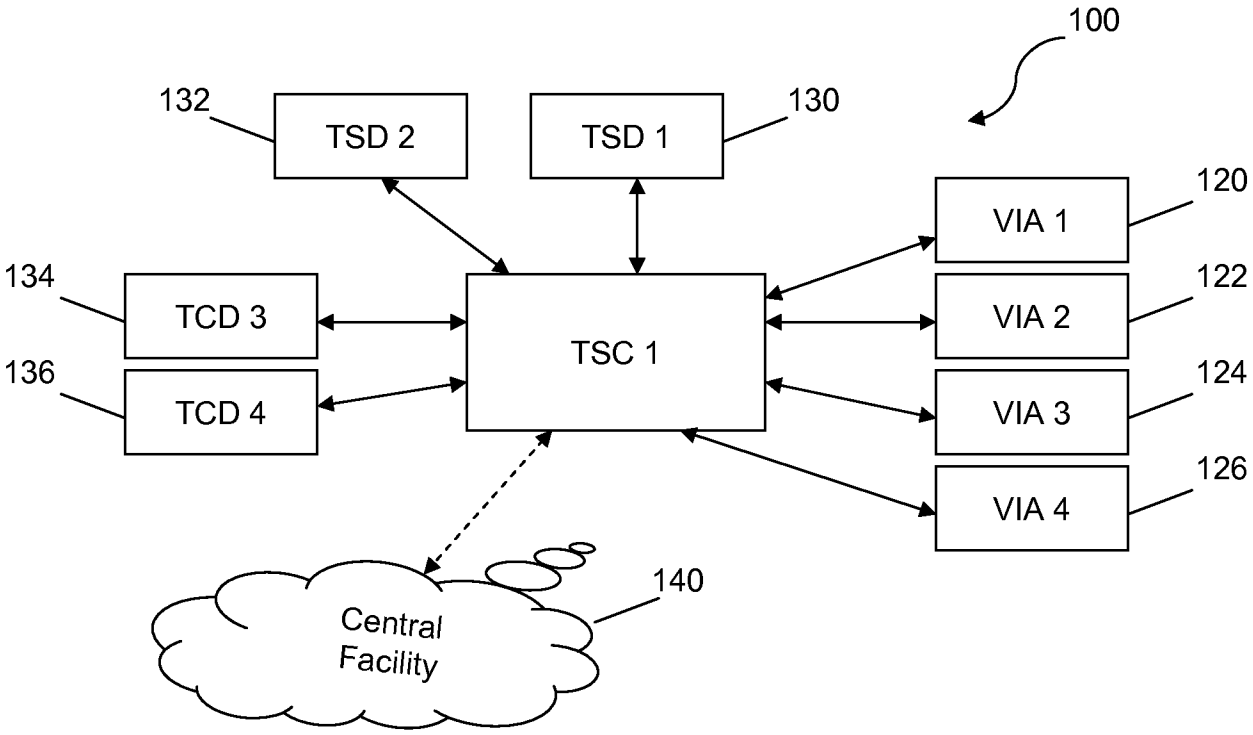
FIG. 1 illustrates an overview of an example of the traffic synchronization system in accordance with an embodiment of the present invention.

FIG. 1 illustrates a diagram of an example of a traffic synchronization system system in accordance with an embodiment of the present invention. The system includes a Traffic Synchronization Controller (TSC) 110, one or more Vehicle Information Agents (VIAs) 120, 122, 124, 126 and one or more traffic control devices 130, 132, 134, 136. In at least one embodiment, the TSC 110, VIAs 120-126 and traffic control devices, 130-136 are all equipped with communication modules that enable the transmission and receipt of information. The Traffic Synchronization Controller 110 communicates with the Vehicle Information Agents 120, 122, 124, 126 and one or more traffic control devices 130, 132, 134, 136.

In some embodiments, the Traffic Synchronization Controller 110 may be programmable computer, personal computer, notebook computer, or the like. In some embodiments, the Vehicle Information Agent 120 may be a programmable computer, personal computer, notebook computer, smart phone, personal digital assistant (PDA), on-board geographic positioning system (GPS), mobile geographic positioning system (GPS), or an on-board automobile valet service such as OnStar offered by OnStar Corporation of Detroit, Mich. The Vehicle Information Agents 120, 122, 124, 126 each resides on a vehicle. When a VIA enters the range of a TSC, the VIA communicates various information related to the associated vehicle to the TSC 110. This information may include, for example, vehicle position, direction, speed, vehicle type, planned route, gas level, number of occupants, user preferences, e.g., fewer stops, more commercial routes, and the like. In some embodiments, the traffic control devices 130, 132, 134, 136 may be traffic lights, street signs, and the like that are capable of changing their state dynamically. Examples of these traffic control devices include traffic lights, speed limit signs, hazard signs, road condition signs, driver information signs, and traffic pattern signs (e.g., reverse traffic flow, high occupancy vehicle limits, time of day or day of week restrictions, etc.). The vehicle route information provides a projection of where the vehicle at a current location will be traveling in the immediate future. User preferences may also be used to assist in projecting and facilitating vehicle routes.

In use, the one or more traffic control devices 130, 132, 134, 136 are placed throughout at least one region of a transportation system, e.g., at multiple traffic light controlled intersections. As vehicles equipped with VIAs 120, 122, 124, 126 approach the controlled intersection or other monitored zone, the VIAs 120, 122, 124, 126 transmit information related to the vehicle to the TSC 110. The TSC 110 uses this received information and calculates the most optimal traffic flow in the region. The TSC 110 then maintains or changes the state of the traffic control devices 130, 132, 134, 136 in order to facilitate the calculated optimal traffic flow. The TSC 110 may also transmit the information received from the VIAs and other information related to the calculated optimal traffic flow to a Central Facility 140 which may also be in communication with other TSCs (not shown) within the region. The Central Facility 140 may use this information in a variety of ways to improve traffic flow within the region including calculating and propagating a regional optimal flow control signal to other TSCs, comparing calculations to improve traffic flow, e.g., time of day, day of week, special event, etc., as well as providing a traffic log that may be used in planning future transportation projects.

Figure 2:
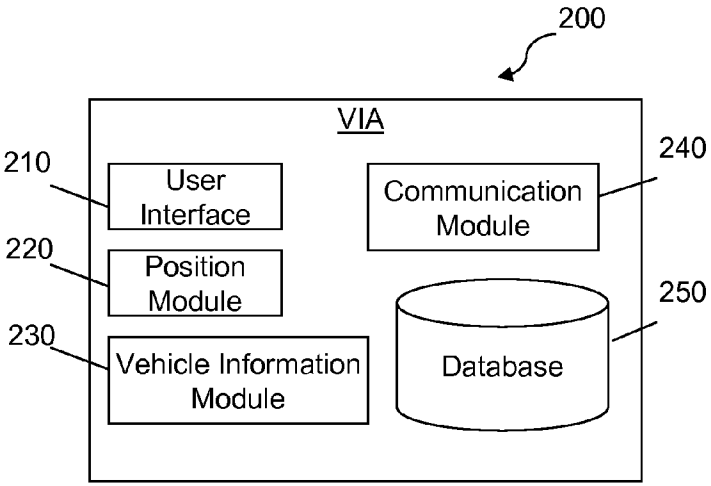
FIG. 2 illustrates a block diagram of an example of a Vehicle Information Agent in accordance with an embodiment of the present invention.

FIG. 2 illustrates an example of a Vehicle Information Agent (VIA) in accordance with an embodiment of the present invention. The VIA 200 includes a user interface 210, position module 220, vehicle information module 230 and communication module 240. The VIA 200 may also optionally include a database or storage medium 250. The user interface 210 allows the user to interact with and set the functions of the VIA including, for example, destination, intended route, information related to the vehicle, information transmitted, user preferences, and the like. The VIA 200 may be flexibly set to transmit a specified level of information. However, it may generally be assumed that higher levels of transmitted information allow the system to produce more optimal decisions regarding traffic flow. The information transmitted by the VIA 200 may include, for example, vehicle route information, e.g., as determined by a GPS unit; vehicle speed; fuel level, especially as related to any final destination reported in the vehicle route information; number of vehicle occupants; vehicle type (passenger, emergency, public safety, delivery, large cargo, etc.); and the like. The signal transmission from the VIA 200 to the TSC may also be flexibly set depending on system requirements and may include, for example, continuous transmission, periodic transmission, transmission in response to a request, transmission based on proximity to a traffic control device, or transmission based on proximity to a predetermined location such as critical points (known bottlenecks, busy intersections, and the like). The position module 220 determines the geographic position, speed, direction, destination, intended route, and other similar information. The position module 220 may, for example, include a GPS sensor or be designed to receive position information from a GPS unit. The vehicle information module 230 stores information related to the vehicle including fuel level, fuel usage, Vehicle Identification Number (VIN), vehicle type (passenger, cargo, mass transit, public safety), length, width, height, number of occupants, maximum occupants, vehicle state (routine transit, special transit, emergency, non-emergency, override, remaining fuel, engine temperature, current speed), etc. Examples of vehicle type and state may include, e.g., police vehicle on routine patrol, ambulance on a rescue mission, city mass transit bus falling behind schedule, etc. The level of priority associated with the various vehicle types and states may be flexibly set to a variety of priority settings. These priority settings allow the TSC to utilize the vehicle type and state information to adjust the traffic control devices to achieve a preferred traffic flow. While communication system including VIA 200, TSC 300 (below) and TCD 400 (below), is typically performed via wireless networking, e.g., cellular data or broadband data, other forms of communications are contemplated. The communication module 240 supports a variety of communication platforms and protocols including local area networks (LAN), wide area networks (WAN), and the like. The communication module 240 enables the VIA 200 to communicate, e.g., transmit data packets using time triggered protocol (TTP), with other devices including TSCs, traffic control devices, GPS devices, and other devices that operate on compatible platforms. The optional database or storage medium 250 may be used to store additional information including, for example, user preferences, vehicle information, frequently used routes, last used route, route alerts, level of information transmitted settings, and the like.

Figure 3:
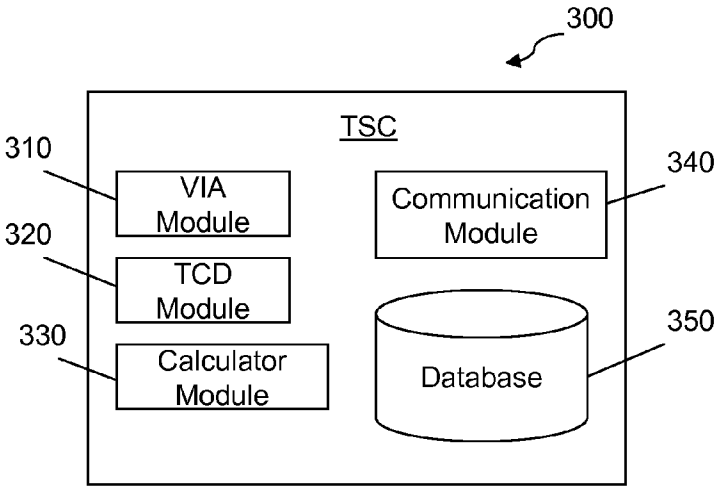
FIG. 3 illustrates a block diagram of an example of a Traffic Synchronization Controller in accordance with an embodiment of the present invention.

FIG. 3 illustrates an example of a Traffic Synchronization Controller (TSC) in accordance with an embodiment of the present invention. The TSC 300 includes a VIA module 310, traffic control device module 320, calculation module 330 and communication module 340. The TSC 300 may also optionally include a database or storage medium 350. The TSC 300 communicates with the VIA and/or traffic control device through communication module 340 to receive information related to the associated vehicle. The VIA module 310 receives and aggregates the various information collected by the TSC 300 including subsets of information. The traffic control module 320 stores information related to the state and settings for each associated traffic control device. The calculation module 330 receives information from the VIA module 310 and traffic control device module 320 and determines a traffic control signal that includes the appropriate setting for each associated traffic control device in order to produce the optimal traffic flow for the region. The communication module 340 transmits the traffic control signal to the traffic control devices. Some examples of how the TSCs may maintain or change the state of the associated traffic control devices includes, but is not limited to, adjusting the length of traffic lights (green, red, and yellow), synchronizing the timing of traffic lights, staggering the timing of traffic lights, adjusting speed limits (both maximum and minimum), altering traffic routes, e.g., reversing traffic lanes, adjusting vehicle occupancy requirements, e.g., high occupancy vehicle (HOV) limits, identifying a "cluster or "pack" of vehicles, forming a "cluster" or "pack" of vehicle, dividing a "cluster" or "pack" vehicles, and the like. The optional database (or storage medium) 350 may be used to store additional information including, for example, aggregate traffic volume, default system settings, aggregate vehicle type, aggregate vehicle state, and the like.

In some embodiments, the TSC 300 is capable of managing a plurality of vehicles as a single "cluster" or "pack". In order to perform this function, the TSC 300 identifies one or more vehicles as the leader(s), one or more vehicles as the follower(s), and one or more vehicles in between the leader(s) and follower(s) as the "rest of the pack". The "cluster" or "pack" may be established, for example, by identifying and labeling a group of vehicles that have all passed a particular point, e.g., as TCD, within a predetermined length of time from each other—with the first vehicle(s) being the leader(s), the last vehicle(s) being the follower(s) and vehicles in between as the rest of the pack". This "clustering" of the "pack" allows the TSC 300 to effectively manage the group of vehicles as a single entity. Further, while the leader(s), follower(s), and "rest of the pack" may change over time, patterns are identified that recognize vehicles traveling as "clusters" or "packs". These recognized patterns allow the TSC 300 to control the TCDs to essentially manage the vehicles as a single vehicle or entity, and thereby optimize throughput of vehicles in the region.

Similarly, these recognized patterns also allow the TSC 300 to actively "cluster" and "divide" packs of vehicles in order to more effectively optimize throughput. For example, if the follower(s) of one cluster begins to lag too far behind the rest of the pack, the TSC 300 may divide those vehicles from that cluster by adjusting a TCD, e.g., as a red light, to hold those vehicles for another approaching cluster. In the same example, the TCD 300 may also hold the entire cluster at a red light to form a larger cluster with other approaching vehicles that are routed in the same direction. The important feature is the ability to recognize patterns and then utilize those patterns to more effectively route and control the flow of traffic through the system.

Figure 4:
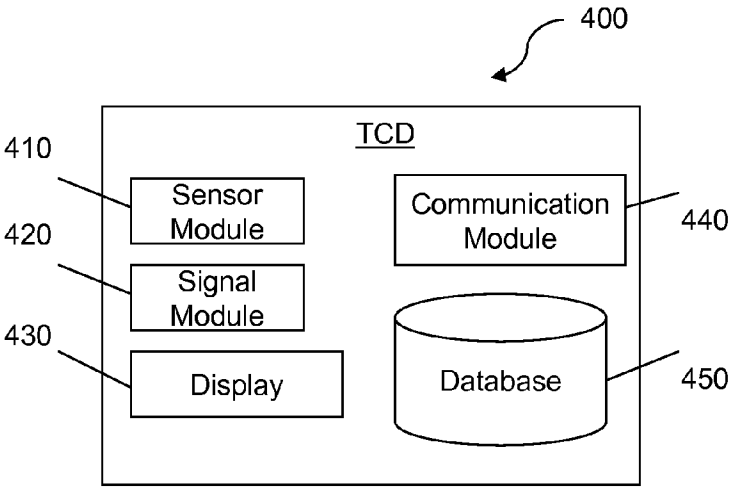
FIG. 4 illustrates a block diagram of an example of a traffic control device in accordance with an embodiment of the present invention.

FIG. 4 illustrates an example of a traffic control device in accordance with an embodiment of the present invention. The traffic control device 400 includes signal module 420, display 430, and communication module 440. The traffic control device 400 may also optionally include a sensor module and/or database (or storage medium) 450. The traffic control device 400 communicates with the TSC and/or VIA through the communication module 440. In various embodiments, the traffic control device may communicate directly with the TSC, directly with the VIA, or communication with both the TSC and VIA. The signal module 420 receives a traffic control signal from the TSC that indicates the appropriate state for the traffic control device. The traffic control signal may contain various instructions with respect to maintaining or changing the state of the traffic control device including, for example, adjusting the length of traffic lights (green, red and yellow), synchronizing the timing of traffic lights, staggering the timing of traffic lights, adjusting speed limits (both maximum and minimum), altering traffic routes, e.g., reversing traffic lanes, adjusting vehicle occupancy requirements, e.g., high occupancy vehicle (HOV) limits, and the like. The control display 430 provides a visual output of the traffic control signal. The control display 430 may be embodied in the form of a variety of traffic control displays including, but not limited to, traffic lights, speed limit signs, hazard signs, warning signs, road condition signs, driver information signs, and traffic pattern signs (e.g., reverse traffic flow, high occupancy vehicle limits, time of day or day of week restrictions, etc.). The optional sensor module 410 performs similar functions as the VIA module of the TSC. The sensor module 410 is capable of receiving and aggregating various vehicle/traffic related information including subsets of information either from the TSC or directly from the VIA. The determined ratio of VIA equipped vehicles to non-VIA equipped vehicles may be used to adjust and improve TSC calculations and actions. Therefore, the sensor module 410 is also capable of making gross vehicle counts utilizing, for example, inputs from cameras and/or inductive loop mechanisms (not shown). The cameras and/or gross vehicle count mechanisms thereby improve the reliability and predictive ability of the system by accounting for vehicles that are not equipped with a VIA such that the TSC can more effectively optimize the flow of traffic. The optional database or storage medium 450 may be used to store additional information including, for example, aggregate traffic volume, supplemental traffic count (from sensor module), default system settings, aggregate vehicle type, aggregate vehicle state, and the like. Upon receiving a signal from the TSC to change the state of the traffic control device, the corresponding traffic control signal is displayed on the traffic control device 400 such that traffic is appropriately controlled at the signal. Similarly, other traffic control devices in the network are appropriately controlled to effectively optimize the flow of traffic within the region.

Figure 5A:
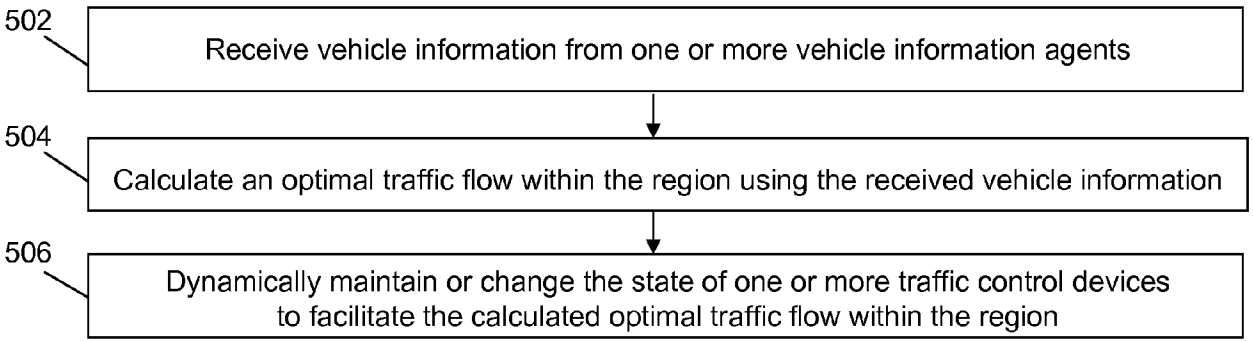
FIG. 5A illustrates an example of a method in accordance with an embodiment of the present invention.

FIG. 5A illustrates an example of a method in accordance with an embodiment of the present invention. The method 500 may be enabled by various embodiments of the invention described herein to collect information related to vehicle traffic within a region and utilize that collected information to dynamically maintain or change the state of traffic control devices within the region in order to optimize the flow of traffic. The method 500 is initialized at 502 by receiving from one or more vehicle information agents a variety of information related to one or more vehicles. At 504, using the vehicle information to calculate an optimal traffic flow within the region. At 506, dynamically maintaining or changing the state of the one or more traffic control devices in order to facilitate the calculated optimal traffic flow within the region.

Figure 5B:
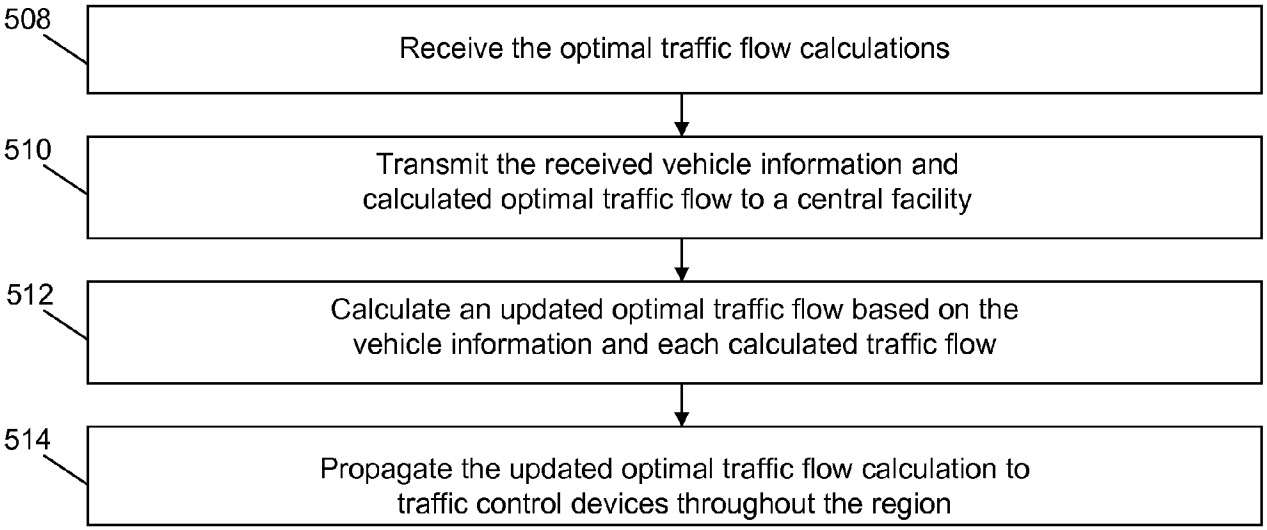
FIG. 5B illustrates an example of an optional method in accordance with an embodiment of the present invention.

FIG. 5B illustrates an example of an optional method in accordance with an embodiment of the present invention. The traffic flow calculations made in accordance with the method embodied in FIG. 5A above may optionally utilized to further optimize the traffic flow within the region (or within adjacent regions). At 508, optionally transmitting the vehicle information received from the one or more vehicle information agents and each calculated optimal traffic flow to a central facility. At 510, calculating an updated optimal traffic flow based on the vehicle information and each calculated optimal traffic flow. At 512, propagating the updated optimal traffic flow calculation to traffic control devices throughout the region (or adjacent regions) in order to dynamically control the traffic control devices to ensure an optimal flow of traffic within the region and/or adjacent regions. The method of the present may also optionally transmit a recommended route or rerouting information to vehicles, based upon the optimal traffic flow calculations and the intended destination of the vehicle (received from the GPS).

As discussed in more detail below, the vehicle information modules (VIAs) can also transfer information about the identity of the vehicle and its state (e.g., police vehicle on routine patrol, ambulance on a rescue mission, city bus falling behind schedule, etc.) and use this information to moderate traffic to beneficial effect. These in-vehicle components can take many forms, including incorporation with on-board GPS, mobile GPS, OnStar, or other similar devices. To ensure that information is being sent from moving vehicles only (as opposed to parked cars, a person walking with a mobile unit, etc.), the TSC can match position with the vehicle's identity (if the vehicle is not moving) in order to determine whether the vehicle is parked, in an accident, in a traffic jam, etc. Or, as an optimization, the VIA can limit transmissions to times when the VIA is in motion, e.g., at a minimal speed greater than normal walking speed.

TSCs can be associated with traffic lights, traffic control signs having dynamic screens (e.g., speed limit signs, stop/yield signs, etc.), or they may simply be positioned at critical traffic points to contribute information to the overall TSC network (e.g., along an open stretch of highway). TSCs capture information broadcast from VIAs within their region and, in a given implementation, can have the ability to use this information to control the traffic control devices connected to it. The TSC transmits the captured information to a central facility that aggregates the input of all TSCs and uses it to calculate any needed adjustments to each traffic control device in the system. An example of how the TSC is utilized to optimize traffic flow is outlined below with respect to FIG. 7.

Figure 6:
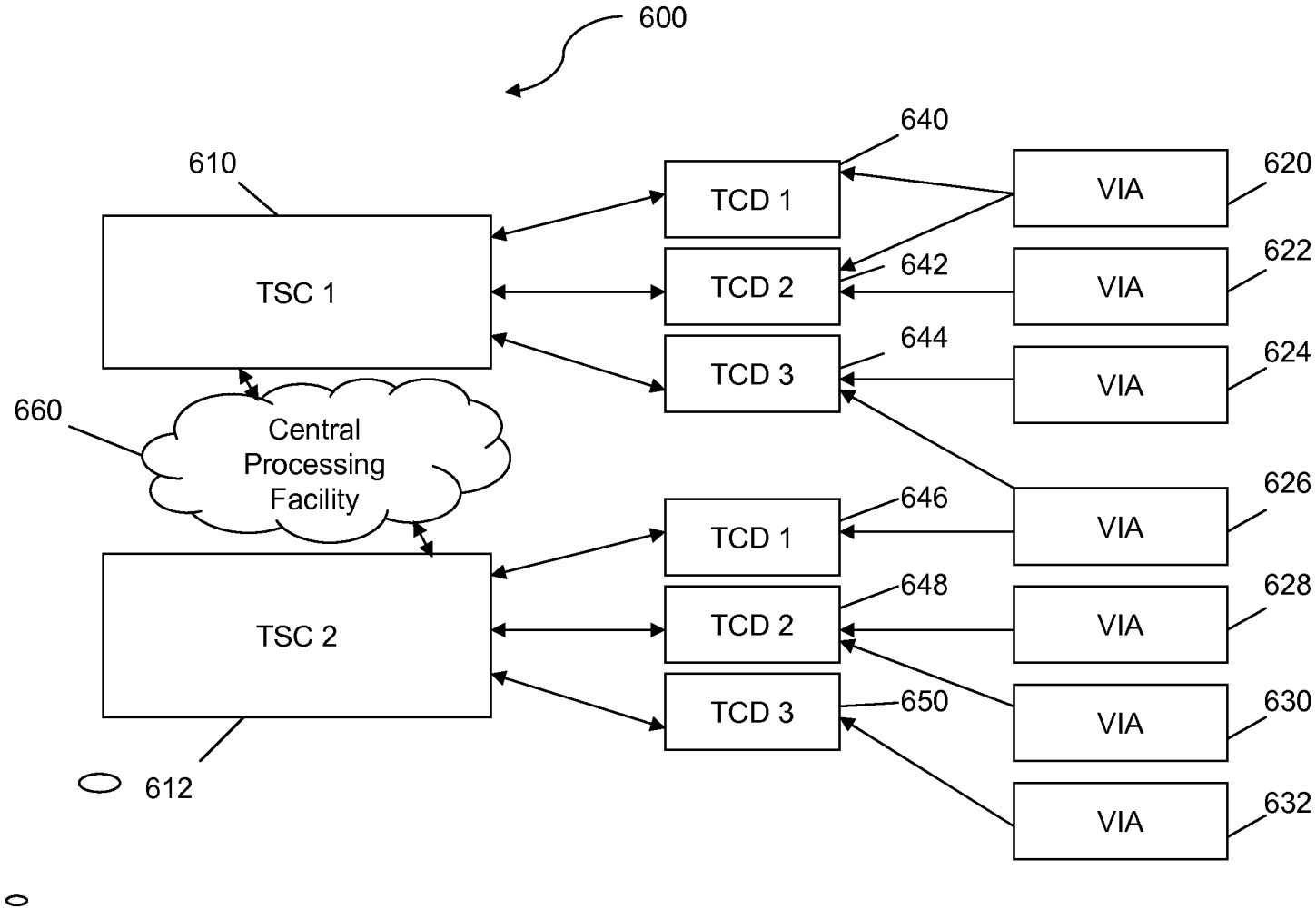
FIG. 6 illustrates an overview of an example of the traffic synchronization system in accordance with an alternative embodiment of the present invention.

FIG. 6 illustrates an overview of an example of the traffic synchronization system in accordance with an alternative embodiment of the present invention. The system 600 includes one or more Traffic Synchronization Controllers (TSCs) 610, 620, one or more Vehicle Information Agents (VIAs) 620, 622, 624, 626, 628, 630, 632, and one or more traffic control devices 640, 642, 644, 646, 648, 650. In at least one embodiment, each of the TSCs 610, 612, VIAs 620-632, and traffic control devices 640-650 are equipped with communication modules that enable the transmission and receipt of information. The TSCs 610, 612 communicate with the one or more traffic control devices 640-650. The traffic control devices 640-650 communicate with both the one or more TSCs 610, 612 and the one or more VIAs 620-632.

Although arranged differently, the alternative embodiment of the traffic synchronization system illustrated in FIG. 6 includes similar components as the embodiment of the traffic synchronization system illustrated in FIG. 1. The VIAs 620-632 reside on each vehicle. However, in this embodiment, the VIAs 620-632 communicate with the traffic control devices 640-650. When a VIA 620-632 enters the range of one of the traffic control devices 640-650, the VIA communicates various information related to the associated vehicle to the traffic control device. This information may include, for example, vehicle position, direction, speed, vehicle type, planned route, gas level, number of occupants, and the like. The traffic control devices 640-650 may include, for example, traffic lights, street signs, and the like that are capable of changing their state dynamically. Examples of these traffic control devices include traffic lights, speed limit signs, hazard signs, road condition signs, driver information signs, and traffic pattern signs (e.g., reverse traffic flow, high occupancy vehicle limits, time of day or day of week restrictions, etc.). The vehicle route information provides a projection of where the vehicle at a current location will be traveling in the immediate future.

In use, the one or more traffic control devices 640-650 are placed throughout at least one region of a transportation system, e.g., at multiple traffic light controlled intersections. As vehicles equipped with VIAs 620-632 approach the controlled intersection or other monitored zone, the VIAs 620-632 transmit information related to the vehicle to the traffic control device 640-650. The traffic control devices 640-650 transmit this information to the TSC 610 or 612. The traffic control devices 640-650 may either transmit this information as it is received or the received information may be stored and transmitted periodically, e.g., in short intervals, as required. The TSCs 610, 612 collects this transmitted information and calculates the most optimal traffic flow in the region. The TSCs 610, 612 then transmits instructions to the traffic control devices 640-650 to appropriately maintain or change their state in order to facilitate the calculated optimal traffic flow.

The TSCs 610, 612 may also transmit the information received from the traffic control devices 640-650 and other information related to the calculated optimal traffic flow to a Central Facility 660 which may also be in communication with other TSCs (not shown) within the region. The Central Facility 660 may use this information in a variety of ways to improve traffic flow within the region including calculating and propagating a regional optimal flow control signal to other TSCs, comparing calculations to improve traffic flow, e.g., time of day, day of week, special event, etc., as well as providing a traffic log that may be used in planning future transportation projects.

Figure 7:
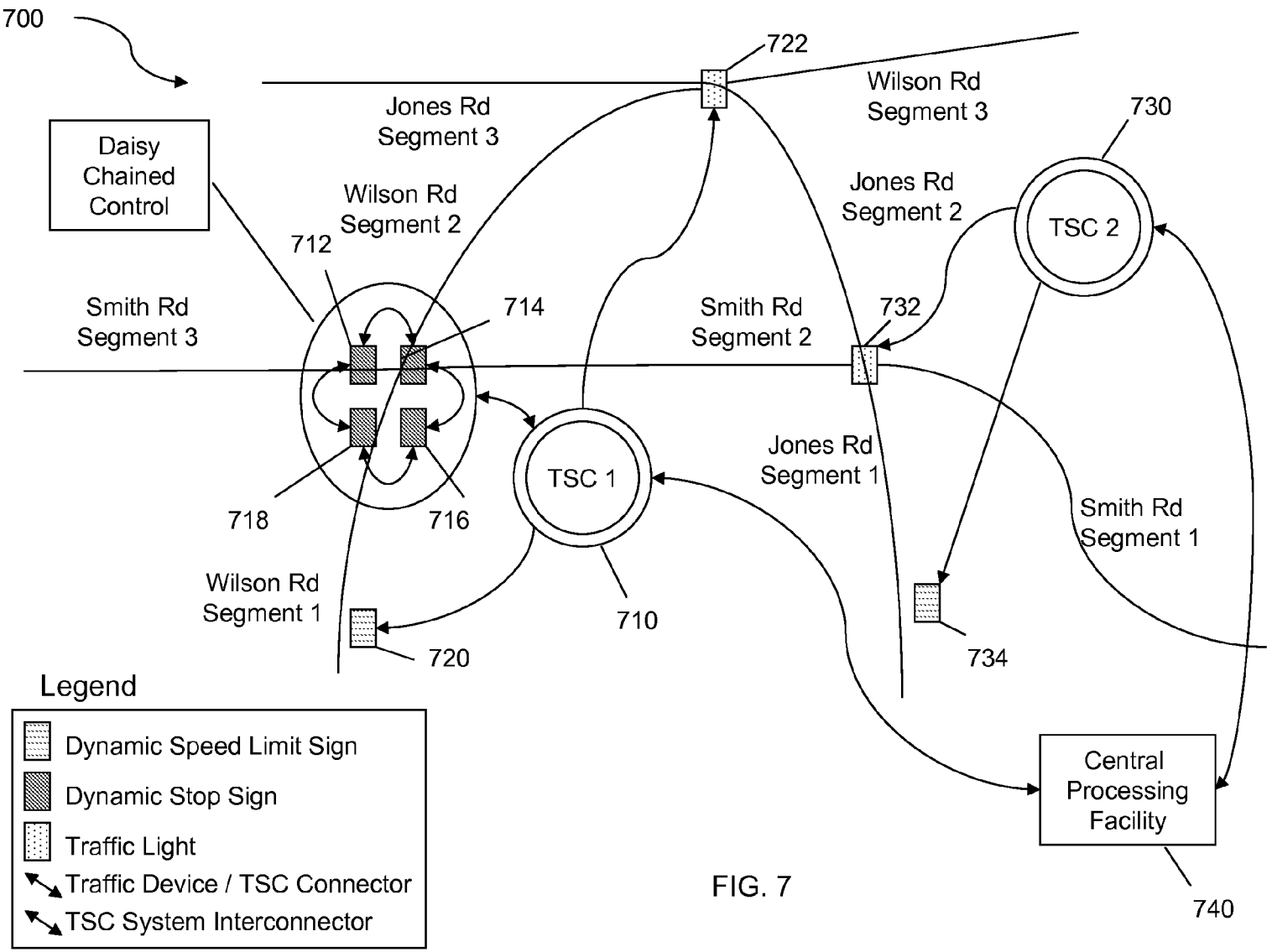
FIG. 7 illustrates an example of the traffic synchronization system in accordance with the present invention in use.

FIG. 7 illustrates an example of the traffic synchronization control system in accordance with the present invention in use. The traffic synchronization control system 700 is described below with respect to controlling the flow of traffic within the region defined by the outlined map. The traffic synchronization control system 700, as illustrated, includes a traffic synchronization controller (TSC1) 710, dynamic stop signs 712, 714, 716, 718, dynamic speed limit sign 720, traffic light 722, traffic synchronization controller (TSC2) 730, traffic light 732, dynamic speed limit sign 734, and central processing facility 740. TSC1 710 is in communication with dynamic stop signs 712, 714, 716, 718, dynamic speed limit sign 720, and traffic light 722. TSC2 730 is in communication with traffic light 732, and dynamic speed limit sign 734. TSC1 and TSC2 are both in communication with central processing facility 740.

In terms of the existing traffic within the region, the following assumptions, parameters, and considerations are provided. First, assume that Segment 1 in Wilson Road, Jones Road, and Smith Road currently each have a traffic rate of 30 vehicles per minute and a capacity of 30 vehicles per minute at each road's speed limit. Second, assume that segment two of each road is capable of handling 30 vehicles per minute, and currently have rates of 24-28 vehicles per minute (over a prescribed period). Third, assume that Segment 3 of Wilson Road has a capacity of 30 vehicles per minute and its current rate is 30 vehicles per minute. Fourth, consider that the system currently seems to support stable traffic flow, and it appears that no adjustments to traffic controls are necessary. Fifth, consider that data received by TSC1 710 associated with the intersections of Wilson Road & Smith Road (via traffic control devices 712, 714, 716, 718), and Wilson Road & Jones Road (via traffic control device 722), and TSC2 730 associated with the intersection of Jones Road & Smith Road (via traffic control device 732), indicate that the number of vehicles that will be turning right in a north bound direction from Smith Road onto Jones Road, and the number of vehicles that will be turning right in a south bound direction from Jones Road onto Wilson Road will result in a traffic backup starting on Segment 3 of Wilson Road, and then backing up Segment 2 for both Jones Road and Wilson Road.

Based on these assumptions, parameters, and considerations TSC1 710 and TSC2 730 of the traffic synchronization control system 700 will make the appropriate calculations and transmit traffic control signals based on these calculations to the associated traffic control device to prevent the impending backup and ensure an optimal flow of traffic within the region. TSC1 710 transmits a traffic control signal to the dynamic speed limit sign 720 on Segment 1 of Wilson Road to reduce the speed of traffic. TSC1 710 also transmits a traffic control signal to the traffic light 722 at the intersection of Wilson Road and Jones Road to slightly reduce the length of the green light in the direction of the traffic congestion, i.e., the south bound and east bound directions. Simultaneously, TSC2 730 transmits a traffic control signal to the dynamic speed limit sign 734 on Segment 1 of Jones Road to reduce the speed of traffic. TSC2 730 also transmits a traffic control signal to the traffic light 732 at the intersection of Smith Road and Jones Road to slightly reduce the length of the green light in the direction of the traffic congestion, i.e., west bound and north bound directions. These adjustments allow the traffic to moderate and alleviate the congestion in the direction of the potential congestion. Further, the information may be transmitted from TSC1 710 and TSC2 730 to central processing facility 740 and used to calculate updated optimal traffic controls based on the information from both TSCs. Further still, dynamic signs (not shown) may be used to alert drivers to voluntarily use alternate routes when traffic congestion is predicted by the traffic synchronization system 700.

It should be noted that a TSC network will, of necessity, have boundaries. For instance, two neighboring municipalities may each implement a TSC network, e.g., System 1 and System 2, respectively. These two systems may be set to cooperate with each other or operate independently. In each instance, improvements in the traffic flow can be expected. However, if the systems are set to cooperate, System 1 can notify System 2 of the level of traffic (quantity, rate) it anticipates will be exiting its own geographic area (region), and entering System 2. System 2 can then utilize this information in calculating adjustments to its own system. However, if the systems do not cooperate, there will still be significant improvements to traffic flow. For instance, the traffic exiting System 1 has been moderated by the TSC network to achieve the best possible flow. As the traffic leaving System 1 enters System 2, the benefits from the control applied by System 1 are realized by System 2. As soon as the traffic enters System 2 and encounters a TSC, it becomes a part of the planning and coordination (optimization) of System 2.

Further, as the number of VIA-equipped vehicles within the system increases, the effectiveness of the system increases. Each vehicle information agent can be set by its operator to transmit a level of information. It may be generally assumed that higher levels of transmitted information allow the TSC to produce more optimal decisions regarding traffic flow. The aggregate vehicle information collected at any one location may be used to adjust the state of the traffic control device, and pertinent subsets of that data may also be provided to a network of TSCs, e.g., propagated (i.e., 'pushed') by the local TSC. In addition to locally collected data, TSCs may use this shared data to adjust their own state. This allows each TSC to determine the best current state for its associated traffic control devices in order to produce an optimal traffic flow for a geographic region. TSCs may also propagate state changes of their associated traffic control device to all other TSCs in the network.

The boundaries of the TSC network can be flexible or fixed, symmetric or asymmetric, and variable from location to location. For instance, at one location, the network may involve other TSCs that are all within two 'hops' of the local TSC. That is, the furthest TSC will have one TSC between it and the local TSC. Alternatively, the extent of the network can be determined by how far individual TSCs broadcast their information. Further, the boundary may change according to time of day, the volume of traffic, or other similar factors that impact traffic congestion. The boundaries need not be symmetric. The depth, i.e., number of 'hops', of TSCs along a specific axis defined by street or geographic orientation (e.g., east-west) or furthest TSC, may be greater than along other axes. TSCs have constraints which determine minimum and maximum time periods between state changes. Other constraints are also possible. For example police and emergency vehicles can be given preferential scheduling along their route based on an emergency at their destination. Similarly, a public transportation vehicle may be given a high priority if the vehicle is behind schedule along a route.

Because TSCs are continually collecting information that includes the number of vehicles, and vehicle speed, for any location on any day, at any time of day, they are capable of detecting the effectiveness of their collective state change decisions. Therefore, they can learn to adjust their behavior to achieve near optimal traffic flow across diverse conditions. The systems are also capable of conveying forecasts to the TSC network. For instance, if it is known that a large amount of traffic will accumulate at a certain time, in a certain area, and/or along certain streets, this information can be used by the TSC network to proactively make adjustments to alleviate traffic from that area preceding the time of the event. If the event is a repeating event, such as traffic due to daily commutes, concerts, or a college football game, the TSC network can use prior instances to assess the degree of success in maintaining good traffic flow, and make continual improvements over time.

The TSCs are capable of communicating with one or more VIAs and/or one or more TCDs. In all embodiments, the TSCs will communicate with at least one VIA or TCD. In various embodiments, the TSCs may communicate with multiple VIAs and/or multiple TCDs.

TSC can talk to one or more VIAs and/or one or more TCDs. So, of the two types of devices the TSC can communicate with (VIA and TCD) it might communicate with either or both types in a given embodiment, and in any case, must communicate with at least one of these types. And, for the types of device it does communicate with, it can communicate with one or more devices The invention can take the form of an entirely hardware embodiment, an entirely software embodiment or an embodiment containing both hardware and software elements. In at least one exemplary embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem, wireless data modems, and Ethernet cards are just a few of the currently available types of network adapters.

As will be appreciated by one of ordinary skill in the art, the present invention may be embodied as a computer implemented method, a programmed computer, a data processing system, a signal, and/or computer program. Accordingly, the present invention may take the form of an entirely hardware embodiment, an entirely software embodiment or an embodiment combining software and hardware aspects. Furthermore, the present invention may take the form of a computer program on a computer-usable storage medium having computer-usable program code embodied in the medium. Any suitable computer readable medium may be utilized including hard disks, CD-ROMs, optical storage devices, carrier signals/waves, or other storage devices.

Computer program code for carrying out operations of the present invention may be written in a variety of computer programming languages. The program code may be executed entirely on at least one computing device, as a stand-alone software package, or it may be executed partly on one computing device and partly on a remote computer. In the latter scenario, the remote computer may be connected directly to the one computing device via a LAN or a WAN (for example, Intranet), or the connection may be made indirectly through an external computer (for example, through the Internet, a secure network, a sneaker net, or some combination of these).

It will be understood that each block of the flowchart illustrations and block diagrams and combinations of those blocks can be implemented by computer program instructions and/or means. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions specified in the flowcharts or block diagrams.

The exemplary embodiments described above may be combined in a variety of ways with each other. Furthermore, the steps and number of the various steps illustrated in the figures may be adjusted from that shown.

It should be noted that the present invention may, however, be embodied in many different forms and should not be construed as limited to the embodiments set forth herein; rather, the embodiments set forth herein are provided so that the disclosure will be thorough and complete, and will fully convey the scope of the invention to those skilled in the art. The accompanying drawings illustrate exemplary embodiments of the invention.

Although the present invention has been described in terms of particular exemplary embodiments, it is not limited to those embodiments. Alternative embodiments, examples, and modifications which would still be encompassed by the invention may be made by those skilled in the art, particularly in light of the foregoing teachings.

Those skilled in the art will appreciate that various adaptations and modifications of the exemplary embodiments described above can be configured without departing from the scope and spirit of the invention. Therefore, it is to be understood that, within the scope of the appended claims, the invention may be practiced other than as specifically described herein.

We claim:

1. A system for optimizing traffic flow based on information transmitted from one or more vehicle information agents, comprising:

at least one traffic synchronization controller in communication with at least one vehicle information agent, wherein said at least one traffic synchronization controller:

receives information transmitted by said at least one vehicle information agent, said information including vehicle position, direction, speed, vehicle type, planned route, gas level, and number of occupants, and calculates an optimal traffic flow within a region based on the received information; and, at least one traffic control device in communication with said at least one traffic synchronization controller, wherein said at least one traffic control device includes at least one of a high occupancy vehicle sign and a traffic route sign, wherein said at least one traffic control device:

receives the calculated optimal traffic flow from said at least one traffic synchronization controller, and dynamically maintains or changes states in order to facilitate the calculated optimal traffic flow within the region.

2. The system according to claim 1, further comprising a central facility in communication with said at least one traffic synchronization controller, wherein said central facility receives the information related to said automobiles and the calculated optimal traffic flow from each of said at least one traffic synchronization controllers.

3. The system according to claim 2, wherein said central facility calculates an updated optimal traffic flow based on the vehicle information and calculated optimal traffic flows.

4. The system according to claim 3, wherein said central facility propagates the updated optimal traffic flow calculation to traffic control devices within the region or in adjacent regions in order to further improve traffic flow.

5. The system according to claim 1, wherein said vehicle information agent includes:

a user interface, wherein said user interface allows users to set and adjust the settings of the vehicle information agent;

a position module, wherein said position module is capable of providing a variety of information related to the geospatial position of the vehicle;

a vehicle information module, wherein said vehicle information module stores information related to the vehicle; and, a communication module, wherein said communication module enables the transmission and receipt of information from one of a traffic synchronization controller and/or a traffic control device.

6. The system according to claim 5, wherein said vehicle information agent further includes a database capable of storing a variety of information and settings.

7. The system according to claim 1, wherein said traffic synchronization controller includes:

a vehicle information module, wherein said vehicle information module receives and aggregates the vehicle information;

a traffic control device module, wherein said traffic control device module stores information related to the state and settings of each of said at least one traffic control device;

a calculation module, wherein said calculation module determines a traffic control signal that includes the appropriate state for each of said one or more traffic control device;

a communication module, wherein said communication module enables communication with said at least one vehicle information agent and said at least one traffic control device; and, a database capable of storing a variety of information and settings.

8. The system according to claim 1, wherein said traffic control device includes:

a signal module, wherein said signal module receives a traffic control signal setting from said traffic synchronization controller;

a communication module, wherein said communication module enables communication with said traffic synchronization controller; and, a display, wherein said display is capable of providing and dynamically changing a traffic control signal.

9. The system according to claim 8, wherein said traffic control device further includes a database capable of storing a variety of information and settings.

10. The system according to claim 8, wherein said traffic control device further includes a sensor module capable of: receiving and aggregating a variety of vehicle and traffic related information, and, making gross vehicle counts.

11. The system according to claim 1, wherein said traffic synchronization controller utilizes said received information to identify clusters of vehicles.

12. The system according to claim 1, wherein said traffic synchronization controller maintains or changes the state of said at least one traffic control device in order to form a cluster of vehicles.

13. The system according to claim 1, wherein said traffic synchronization controller maintains or changes the state of said at least one traffic control device in order to divide a cluster of vehicles.

14. A method for optimizing traffic flow based on information transmitted by one or more vehicle information agents, comprising:

providing one or more traffic synchronization controllers within a region, wherein said one or more traffic synchronization controllers is capable of receiving and transmitting information related to one or more vehicles, said information including vehicle position, direction, speed, vehicle type, planned route, gas level, and number of occupants;

providing one or more traffic control devices within the region, wherein said one or more traffic control devices is capable of dynamically changing control states, wherein said one or more traffic control devices include at least one of a high occupancy vehicle sign and a traffic route sign;

receiving on said one or more traffic synchronization controllers information transmitted by one or more vehicle information agents; calculating an optimal traffic flow within the region based on the information received; and, dynamically maintaining or changing the state of one or more traffic control devices within the region to facilitate the calculated optimal traffic flow within the region.

15. The method according to claim 14, further comprising: propagating the updated optimal traffic flow calculation to one or more traffic control devices within the region or in adjacent regions in order to further improve traffic flow.

16. The method according to claim 14, further comprising: transmitting a recommended route to vehicles based at least in part upon the optimal traffic flow calculation.

17. A system for optimizing traffic flow comprising:

at least one vehicle information agent capable of being disposed on an automobile, wherein said at least one vehicle information agent transmits information related to said automobile;

at least one traffic synchronization controller in communication with said at least one vehicle information agent, wherein said at least one traffic synchronization controller:

receives information transmitted by said at least one vehicle information agent, said information including vehicle position, direction, speed, vehicle type, planned route, gas level, and number of occupants, and calculates an optimal traffic flow within a region based on the received information; and, at least one traffic control device in communication with said at least one traffic synchronization controller, wherein said at least one traffic control device includes a high occupancy vehicle sign and a traffic route sign, wherein said at least one traffic control device:

receives the calculated optimal traffic flow from said at least one traffic synchronization controller, and dynamically maintains or changes states in order to facilitate the calculated optimal traffic flow within the region.

18. The system according to claim 1, wherein said traffic control device includes at least one high occupancy vehicle sign including at least one of:

minimum number of occupant restrictions; and time restrictions.

19. The system according to claim 1, wherein said traffic control device includes at least one traffic route sign such that changing a state of said traffic route sign reverses a direction of a traffic lane.

* * * * *